US005526956A

United States Patent [19]

Osgar

[11] Patent Number: 5,526,956

[45] Date of Patent: Jun. 18, 1996

[54] LIQUID CHEMICAL DISPENSING AND RECIRCULATING SYSTEM

[75] Inventor: Michael L. Osgar, Eagan, Minn.

[73] Assignee: Now Technologies, Inc., Bloomington, Minn.

[21] Appl. No.: 270,037

[22] Filed: Jul. 1, 1994

Related U.S. Application Data

[63] Continuation-in-part of Ser. No. 943,900, Sep. 11, 1992, Pat. No. 5,335,821.

[51] Int. Cl.[6] ..... B67D 5/54

[52] U.S. Cl. ..... 222/83; 222/91; 222/105; 222/400.7

[58] Field of Search ..... 222/83, 83.5, 88, 222/91, 95, 105, 400.7, 464.1

[56] References Cited

U.S. PATENT DOCUMENTS

| | | | |
|---|---|---|---|
| Re. 27,626 | 4/1973 | Johnston | 222/400.7 |
| 665,252 | 1/1901 | Morawetz | 137/212 |
| 665,672 | 8/1900 | Engel | 137/212 |
| 729,145 | 5/1903 | Eckenwiler | 137/212 |
| 850,070 | 4/1907 | Spikes . | |
| 928,813 | 7/1909 | Spikes . | |
| 1,031,587 | 7/1912 | Reisik . | |
| 1,304,390 | 5/1919 | Semenow et al. . | |
| 1,842,897 | 1/1932 | Culp . | |
| 2,186,925 | 1/1940 | Hooper et al. | 62/1 |
| 2,187,389 | 1/1940 | Winkler | 225/40 |
| 2,453,080 | 11/1948 | Shimp | 222/185 |
| 2,547,084 | 4/1951 | Marcuse | 299/86 |
| 2,790,571 | 4/1957 | Flaith et al. | 217/99 |
| 2,935,338 | 5/1960 | Mills, Jr. | 284/19 |
| 3,005,475 | 10/1961 | Beall, Jr. | 141/198 |
| 3,035,603 | 5/1962 | Jamieson et al. | 137/323 |
| 3,065,885 | 11/1962 | Chatten | 222/400.7 |
| 3,149,763 | 9/1964 | Exton | 222/541 |
| 3,170,667 | 2/1965 | Szohatsky | 251/149.6 |
| 3,194,588 | 7/1965 | Buckey et al. | 285/18 |
| 3,228,413 | 1/1966 | Stevens et al. | 137/322 |
| 3,239,104 | 3/1966 | Scholle | 222/89 |
| 3,265,233 | 8/1966 | Tuuri | 215/9 |
| 3,273,586 | 9/1966 | Killmeyer | 137/268 |
| 3,287,031 | 11/1966 | Simmons et al. | 285/27 |
| 3,326,580 | 6/1967 | Munier et al. | 285/27 |
| 3,342,377 | 9/1967 | Peredy | 222/95 |
| 3,357,602 | 12/1967 | Sichler | 222/400.7 |
| 3,361,152 | 1/1968 | Akers | 137/212 |
| 3,397,620 | 8/1968 | Skelton | 92/24 |
| 3,467,283 | 9/1969 | Kinnavy | 222/95 |
| 3,670,929 | 6/1972 | Berry | 222/400.7 |
| 3,774,820 | 11/1973 | Zucconi | 222/400.7 |
| 3,777,925 | 12/1973 | Eckholm | 220/404 |
| 3,828,977 | 8/1974 | Borchert | 222/95 |
| 3,861,569 | 1/1975 | Johnston | 222/400.7 |
| 3,883,046 | 5/1975 | Thompson et al. | 222/95 |
| 3,892,230 | 11/1975 | Lynn, Jr. | 222/105 |

(List continued on next page.)

FOREIGN PATENT DOCUMENTS

| | | |
|---|---|---|
| 670440 | 9/1963 | Canada . |
| 1187435 | 2/1965 | Germany . |
| 8502184 | 3/1987 | Netherlands . |
| 771968 | 10/1955 | United Kingdom . |
| 762567 | 11/1956 | United Kingdom . |
| 863430 | 3/1959 | United Kingdom . |
| WO82/00780 | 3/1982 | WIPO . |

*Primary Examiner*—Andres Kashnikow
*Assistant Examiner*—Kenneth Bomberg
*Attorney, Agent, or Firm*—Kinney & Lange

[57] ABSTRACT

A container system for high purity fluids includes an outer container having a mouth and a coupling member for insertion into the mouth. The coupling member defines a first fluid passage and a second fluid passage. The first fluid passage terminates within the outer container at a first location while the second fluid passage terminates within the outer container at a second location, The second fluid passage comprises at least one fluid channel circumferentially extending along the first fluid passage so that high purity fluids may be drawn out of the outer container through the first fluid passage and filled into the outer container through the second fluid passage.

7 Claims, 6 Drawing Sheets

U.S. PATENT DOCUMENTS

| | | | |
|---|---|---|---|
| 3,945,534 | 3/1976 | Ady | 222/400.7 |
| 3,952,918 | 4/1976 | Poitras et al. | 222/82 |
| 4,011,288 | 3/1977 | Assenheimer et al. | 222/83.5 |
| 4,089,443 | 5/1978 | Zrinyl | 222/386.5 |
| 4,089,444 | 5/1978 | Shea | 222/400.7 |
| 4,111,514 | 9/1978 | Brishka et al. | 339/186 R |
| 4,134,522 | 1/1979 | Patzke et al. | 222/153 |
| 4,138,036 | 2/1979 | Bond | 222/105 |
| 4,147,278 | 4/1979 | Uhlig | 222/400.8 |
| 4,150,673 | 4/1979 | Watt | 128/272 |
| 4,165,023 | 8/1979 | Schmitt | 222/105 |
| 4,171,757 | 10/1979 | Diamond | 222/389 |
| 4,211,439 | 7/1980 | Moldestad | 285/27 |
| 4,265,374 | 5/1981 | Sebalos | 222/95 |
| 4,271,991 | 6/1981 | Diamond | 222/389 |
| 4,308,973 | 1/1982 | Irland | 220/454 |
| 4,330,066 | 5/1982 | Berliner | 215/1 C |
| 4,362,255 | 12/1982 | Bond | 222/107 |
| 4,411,287 | 10/1983 | Hyde | 137/315 |
| 4,411,546 | 10/1983 | Fischer | 403/23 |
| 4,445,550 | 5/1984 | Davis et al. | 222/105 |
| 4,452,378 | 6/1984 | Christine | 222/107 |
| 4,457,455 | 7/1984 | Meshberg | 222/105 |
| 4,460,361 | 7/1984 | Nichols | 604/319 |
| 4,491,247 | 1/1985 | Nitchman et al. | 222/131 |
| 4,529,105 | 7/1985 | Lewins | 222/153 |
| 4,562,942 | 1/1986 | Diamond | 222/386.5 |
| 4,582,223 | 4/1986 | Kobe | 222/82 |
| 4,641,765 | 2/1987 | Diamond | 222/386.5 |
| 4,665,960 | 5/1987 | Brzezicki et al. | 141/384 |
| 4,674,774 | 6/1987 | Williams | 285/184 |
| 4,699,298 | 10/1987 | Grant et al. | 222/400.7 |
| 4,732,414 | 3/1988 | Inaba | 285/133.1 |
| 4,756,347 | 7/1988 | Hagan et al. | 222/400.7 |
| 4,785,973 | 11/1988 | Kobe | 222/400.7 |
| 4,804,065 | 2/1989 | Scragg | 222/94 |
| 5,102,010 | 4/1992 | Osgar et al. | 222/1 |
| 5,108,015 | 4/1992 | Rauworth et al. | 222/400.7 |
| 5,205,440 | 4/1993 | Matsushita | 222/95 |
| 5,219,185 | 6/1993 | Oddenino | 285/26 |
| 5,335,821 | 8/1994 | Osgar | 222/83 |
| 5,435,460 | 7/1995 | Osgar | 222/83 |

LIQUID CHEMICAL DISPENSING AND RECIRCULATING SYSTEM

This is a continuation-in-part of application Ser. No. 07/943,900, entitled LIQUID CHEMICAL CONTAINER AND DISPENSING SYSTEM which was filed on Sep. 11, 1992, now U.S. Pat. No. 5,335,821.

BACKGROUND OF THE INVENTION

The invention relates to containers for storage, transport and use of liquid chemicals including acids, solvents, bases, photoresists, dopants, inorganic, organic, biological solutions, pharmaceuticals, and radioactive chemicals. In particular, the invention relates to a coupling member mounted within a mouth of a container which permits fluid to be drawn out of and recirculated into the container at the same time through the mouth of the container.

During the shipment of liquid chemicals and high purity fluids, vibration of the shipping container creates contaminating particles within the fluids which lower the purity of the fluids and prevent the ultimate use of the high purity fluids and liquid chemicals once delivered. As a result, it is often necessary to test the high purity fluids for contamination and to filter the high purity fluids to remove the contaminating particles and to re-establish purity. Thus, the liquid chemical or high purity fluids must be withdrawn from the container, tested and/or filtered, and then recirculated back into the container.

Typically, the recirculation of the high purity fluids requires a specialized container having at least two ports or mouths in communication with the interior of the container. Unfiltered or untested fluid is withdrawn out of one of the ports while filtered or tested fluid is recirculated back into the container through the second port. Because recirculation of the fluids requires a specialized container having two ports, recirculation or testing is expensive. In addition, the structural integrity of the container is often impaired by the need for a second additional mouth or port into the container. Moreover, because recirculation has typically required two ports into the interior of the container, container systems employing flexible bags or film pouches within an outer bottle or overpack are not suitable for recirculating fluids for testing or filtering because the flexible film pouch generally includes only a single port.

SUMMARY OF THE INVENTION

The present invention is an improved method of handling high purity fluids and an improved container system for high purity fluids. The container system includes an outer container having a mouth and a coupling member for insertion into the mouth. The coupling member defines two fluid passages extending through the mouth. The first fluid passage terminates within the outer container at a first location. The second fluid passage terminates within the outer container at a second location. The second fluid passage includes at least one fluid channel circumferentially positioned about and extending along the first fluid passage so that high purity fluids may be drawn out of the outer container through the first fluid passage and filled into the outer container through the second fluid passage.

The method includes the steps of providing a container having an outer container and a flexible bag supported within the outer container. The flexible bag of the container has a port which communicates with an interior of the fluid container. The interior of the flexible bag is filled through the port and a coupling member is inserted into the port. The coupling member defines a first fluid passage terminating within the interior of the flexible bag at a first location and a second fluid passage terminating within the flexible bag at a second location. A probe having a first flow passage and a second flow passage is positioned with respect to the coupling member so that the first flow passage is in communication with tile first fluid passage and so that the second flow passage is in communication with the second fluid passage. Fluid is then dispensed from the flexible bag through the first fluid passage and through the first flow passage while fluid is refilled into the flexible bag through the second flow passage and through the second fluid passage.

DETAILED DESCRIPTION OF THE PREFERRED EMBODIMENTS

Figure 1:
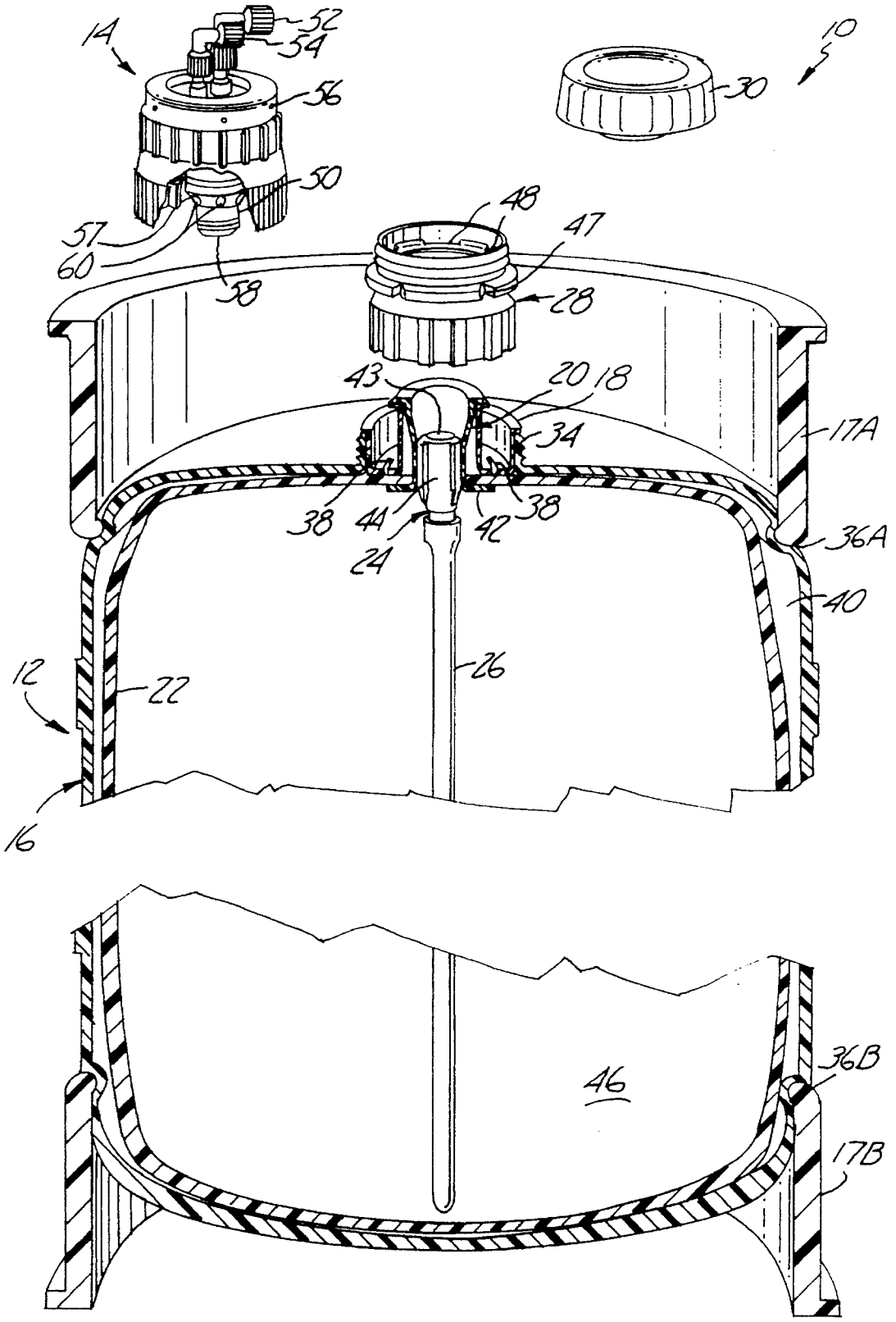
FIG. 1 is a sectional view of a liquid chemical dispensing and recirculating system including a container and a dispenser with portions shown in perspective and portions removed.

FIG. 1 shows a preferred embodiment of a liquid chemical dispensing and recirculating system 10 which includes container 12 and dispenser 14. Container 12 includes outer container 16, chimes 17A,17B, retainer 18. fitment 20, flexible bag 22, dip tube coupling 24, dip tube 26, closure 28 and cap 30. Closure 28 and cap 30 are shown removed from container 12 to better illustrate container 18, fitment 20 and dip tube coupling 24. Dispenser 14 is shown in perspective with portions removed to better illustrate dispenser 14. Closure 28 and cap 30 of container 12 are shown in perspective. The remaining elements of container 12 are shown in section for ease of illustration.

Outer container 16 is generally barrel-shaped and includes an externally threaded mouth 34 in which retainer 18, fitment 20 and dip tube coupling 24 are mounted. Outer container 16 also includes depressions 38A, 38B near the top and bottom for receiving chimes 17A, 17B, respectively. Outer container 16 is preferably a high density polyethylene overpack drum. Alternatively, other plastic materials or metal may be used, depending upon government regulatory specifications for handling of the particular liquid chemical or high purity fluid to be contained within container 12. Outer container 16 provides mechanical support and protection required by flexible bag 22 during filling, transport, handling and dispensing.

Chime 17A is mounted near a top end of outer container 16 to depression 38A and extends above closure 28 so as to protect closure 28 and mouth 30 of container 16. Chime 17A also provides a handle for grasping and carrying container 12. Chime 17B is mounted to container 16 near a lower end of container 16 to depression 38B. Chime 17B provides a base for supporting container 12 in an upright position.

Retainer 18 mounts within mouth 34 of: outer container 16 and includes vent or gas passages 38 which extend through retainer 18 and which are in fluid communication with space 40 between flexible bag 22 and outer container 16. Gas passages 38 permit gas or air to flow into space 40 so that flexible bag 22 may collapse as high purity fluid or liquid chemicals are dispensed from container 12. Alternatively, gas passages 38 provide means by which gas or fluid under pressure may be supplied to space 40 to collapse flexible bag 22 and to force the high purity fluid or liquid chemical up through dip tube 26 and out of container 12. Retainer 18 mounts fitment 20 within mouth 34 of outer container 16.

Fitment 20 is generally funnel-shaped and mounts within retainer 18 and mouth 34 of outer container 16. Fitment 20 includes a lower shoulder 42 which projects outwardly from a lower end of fitment 20. Shoulder 42 of fitment 20 upholds flexible bag 22 within outer container 16.

Flexible bag 22 is a fluid container preferably constructed of a fluoropolymer film, such as polytetrafluoroethylene, with a thickness of about 1 to about 20 millimeters. Depending upon the fluid or liquid chemical being contained, additional film laminates such as nylon, mylar, or metal foil may be added to the fluoropolymer film. For example, a reflective metal foil may be used on an outer surface of flexible bag 22 when the liquid chemical to be stored within flexible bag 22 is a photoresist or other photosensitive liquid. Because flexible bag 22 is precleaned and preferably constructed of inert materials, ionic contamination caused by contact with metallic containers is avoided. Because flexible bag 22 is placed within outer container 16, the film bag can be easily disposed of after liquid chemicals have been dispensed from flexible bag 22. By inserting a fresh, precleaned bag in the existing outer container, contamination, logistics, reuse and environmental issues are addressed. See U.S. Pat. No. 5,102,010 to Osgar et al., issued on Apr. 7, 1992, which is assigned to NOW Technologies, Inc.

Dip tube coupling 24 is generally cylindrically shaped and defines two fluid passages 43,44 which extend through fitment 20 and mouth 34 into interior 46 of flexible bag 22. Fluid passage 43 concentrically extends through dip tube coupling 24 and dip tube 26 and terminates toward the bottom of flexible bag 22. Fluid passage 44 extends along an outer perimeter or circumferential surface of dip tube coupling 24 between dip tube coupling 24 and fitment 20 from toward a top end or fitment 20 to near a bottom end of dip tube coupling 24 within flexible bag 22. Fluid passage 43 permits fluid to be withdrawn from flexible bag 22 through dip tube 26 and through fluid passage 43 while fluid passage 44 permits fluid to be recirculated or filled into flexible bag 22. In addition, fluid passage 44 allows vapor pressure built up within flexible bag 22 to escape when cap 30 is removed. By venting vapor pressure within flexible bag 22, fluid passage 44 prevents dangerous liquid chemical spills caused by liquid chemicals being forced up through dip tube 26 by the vapor pressure when cap 30 is removed.

Dip tube 26 is a hollow, cylindrical tube which includes a fluid conduit which extends from the top end through a bottom end of dip tube 26. Dip tube 26 is mounted to dip tube coupling 24 within flexible bag 22. Dip tube 26 permits container 12 to be kept upright while liquid chemical is dispensed from container 12. Dip tube 26 also insures that the complete contents of container 12 are emptied. Consequently, dip tube 26 allows for safe dispensing of liquid chemical from large containers (e.g. larger than 1 gallon capacity).

Closure 28, otherwise known as a bung ring, is both internally and externally threaded to engage externally threaded mouth 34 of outer container 16 and internally threaded cap 30. Closure 28 further includes key code notches 47 and vent openings 48. Key code notches 47 extend along an outer perimeter of closure 28 and are selectively positioned so as to encode and identify the type of liquid chemical or high purity fluid contained within container 12. Key code notches 47 are positioned so as to match lugs on dispenser 14. As a result, liquid chemical contained within container 12 can only be withdrawn by a specific selected dispenser 14.

Vent openings 48 are inset within closure 28 and are in fluid communication with gas passages 38 of retainer 18. Vent: openings 48 permit gas to flow or to be supplied under pressure through vent openings 48 and through gas passages 38 into space 40 to expel the liquid from container 12. Overall, closure 48 provides a means for connecting dispenser 14 to container 12 and encloses mouth 34, retainer 18, fitment 20 and dip robe coupling 24 to stabilize and protect the enclosed members.

Cap 30 threadably engages the top end of closure 48 when dispenser 14 is not engaged to cover and protect retainer 18. fitment 20 and dip tube coupling 24. Cap 30 also seals with closure 28 to seal liquid chemicals within container 12 during shipment and handling of container 12.

During filling of container 12, flexible bag 22 is first inflated with a gas such as nitrogen. Liquid chemical is then supplied through fitment 20 to fill flexible bag 22 within outer container 16. After bag 22 is filled, dip tube 26 and dip tube coupling 24 are inserted into fitment 20. In order to insure that contamination is kept to a minimum, dip tube coupling 24 and dip tube 26 are immediately installed after flexible bag 22 of container 12 is filled with liquid chemical. Next, closure 28 is screwed onto mouth 34 of outer container 16 and cap 30 is screwed onto closure 28 to seal the liquid chemical within container 12.

Dispenser 14 is used for withdrawing the liquid chemical or high purity fluid from flexible bag 22 of container 12 and for refilling or recirculating the liquid chemical back into container 12 while dip tube coupling 24 and dip tube 26 remain mounted within container 12. Dispenser 14 is illustrated with a fragmentary perspective view to better illustrate dispenser 14. Dispenser 14 generally includes probe 50, flared tube dispense port 52, flared tube recirculation port 54, vent ports 56 and key code lugs 57. Probe 50 defines flow passage 58 and flow passage 60. Flow passage 58 extends through probe 50 and is in communication with dispense port 52. Flow passage 60 extends through probe 50 and is in communication with recirculation port 54. Probe 50 is sized for mating within fitment 20 and dip tube coupling 24 so that flow passage 58 is in fluid communication with fluid passage 43 and so that flow passage 60 is in communication with fluid passage 44.

Vent ports 56 extend through dispenser 14 and are positioned so as to be in fluid communication with vent openings 48 of closure 28 when dispenser 14 engages closure 28 of container 12 during dispensing and/or recirculation of liquid chemicals in container 12. Vent ports 56 permit gas to flow or be supplied under pressure through vent ports 56, vent openings 48 and gas passages 38 into space 40 to allow flexible bag 22 to collapse and to expel liquid chemicals from container 12.

Key code lugs 57 extend along an inner perimeter of dispenser 14 and are selectively positioned so as to match selectively positioned key code notches 47 on closure 28. As a result, dispenser 14 may only engage certain selected matching closures 28. This feature prevents dispenser 14 from being accidentally connected to a container containing the wrong type of liquid chemical.

Once container 12 is transported to the desired site, cap 30 is removed from closure 28. Removal of cap 30 from closure 28 allows built tip vapor pressure within flexible bag 22 to vent through fluid passage 44 so that liquid chemical is not forced tip through dip tube 26. Dispenser 14 is next mounted upon closure 28 to dispense and recirculate liquid chemicals within container 12. Key code lugs 57 engage notches 47 to insure that the correct liquid chemical or high purity fluid is withdrawn and/or recirculated. Probe 50 mates within fitment 20 and dip tube coupling 24 so that flow passage 58 is in fluid communication with fluid passage 43 and so that flow passage 60 is in fluid communication with fluid passage 44. Liquid chemical is then withdrawn from container 12 through flow passage 43, defined by dip tube 26 and dip tube coupling 24, and through flow passage 58, defined by probe 50 and flared tube dispense port 52. After the dispensed liquid chemical is either filtered and/or tested for impurities, dispensed liquid is refilled or recirculated through flow passage 60 within recirculation port 54 and probe 50 and through fluid passage 44 extending along the circumferential surface of dip tube coupling 24. To prevent the back pressure, gas or air is permitted to flow through vent ports 56, vent openings 48 and gas passages 38 into space 40 between flexible bag 22 and outer container 16. Alternatively, pressurized air or gas may be supplied through vent ports 56, vent openings 48 and gas passages 38 into space 40 to aid in dispensing liquid chemical from flexible bag 22.

Liquid chemical container and dispensing system 10 provides several advantages. Because dip tube coupling 24 defines two fluid passages 43,44, liquid chemical or high purity fluids may be both withdrawn and recirculated back into container 12 at the same time through a single port or opening within outer container 16. Moreover, because fluid passage 44 is circumferentially positioned around fluid passage 43, fluid passage 44 has a sufficient flow area to permit filtered and/or tested fluid to be refilled or recirculated into container 12 in less time. At the same time, vent ports 56, vent openings 48 and gas passages 38 permit gas to flow or to be supplied under pressure into space 40 to prevent back pressure within container 12 and to force liquid chemical up through dip tube 26 out of container 12. System 10 provides two liquid or fluid passages which communicate with tile interior 46 of flexible bag 22 and a third gas passage which communicates with space 40 between flexible bag 22 and outer container 16. These passages all extend through a single opening within outer container 16 and are provided with easily manufactured. uncomplicated, less expensive components.

Figure 2:
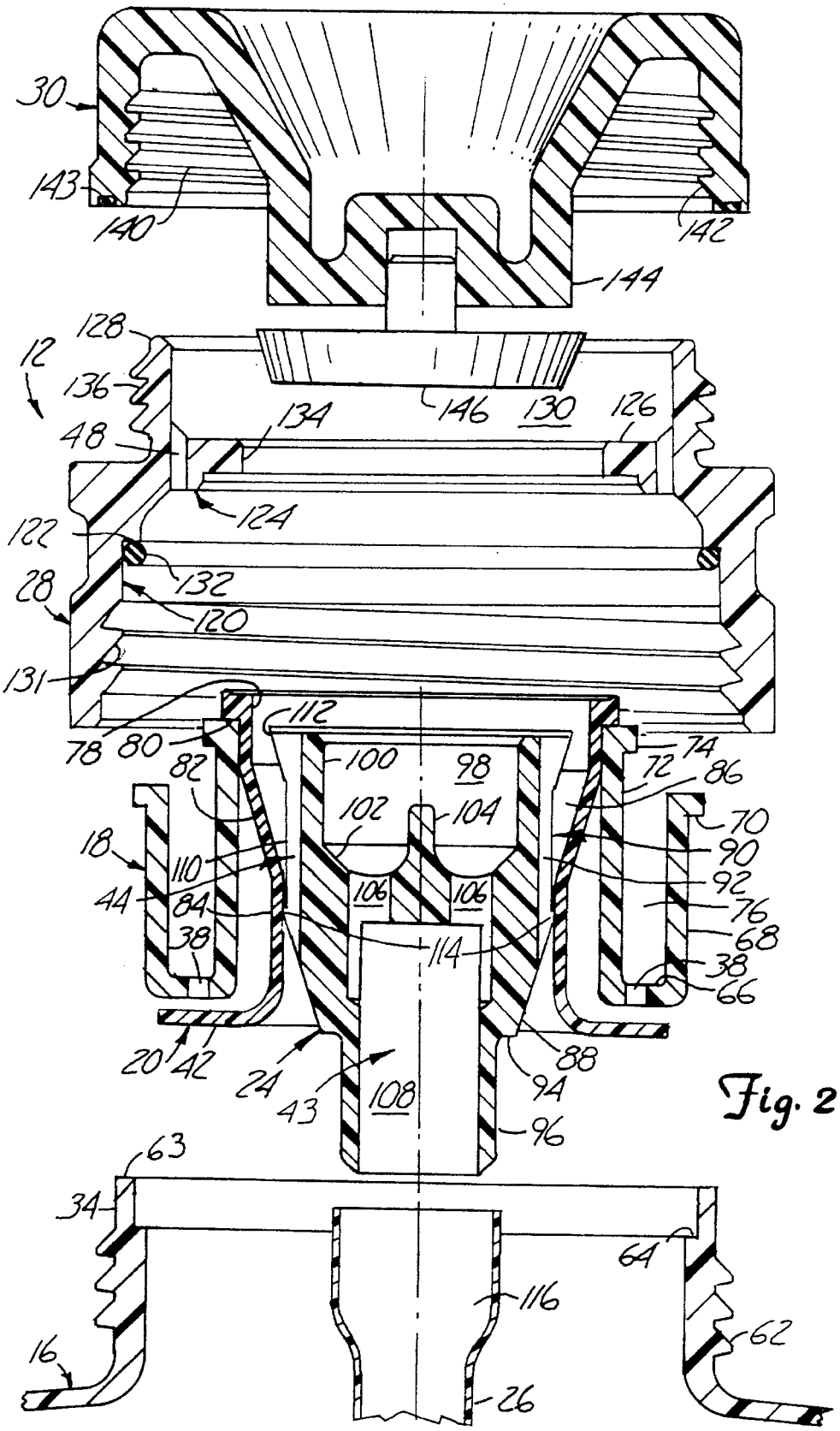
FIG. 2 is an exploded sectional view of a top portion of the container of FIG. 1.
Figure 3:
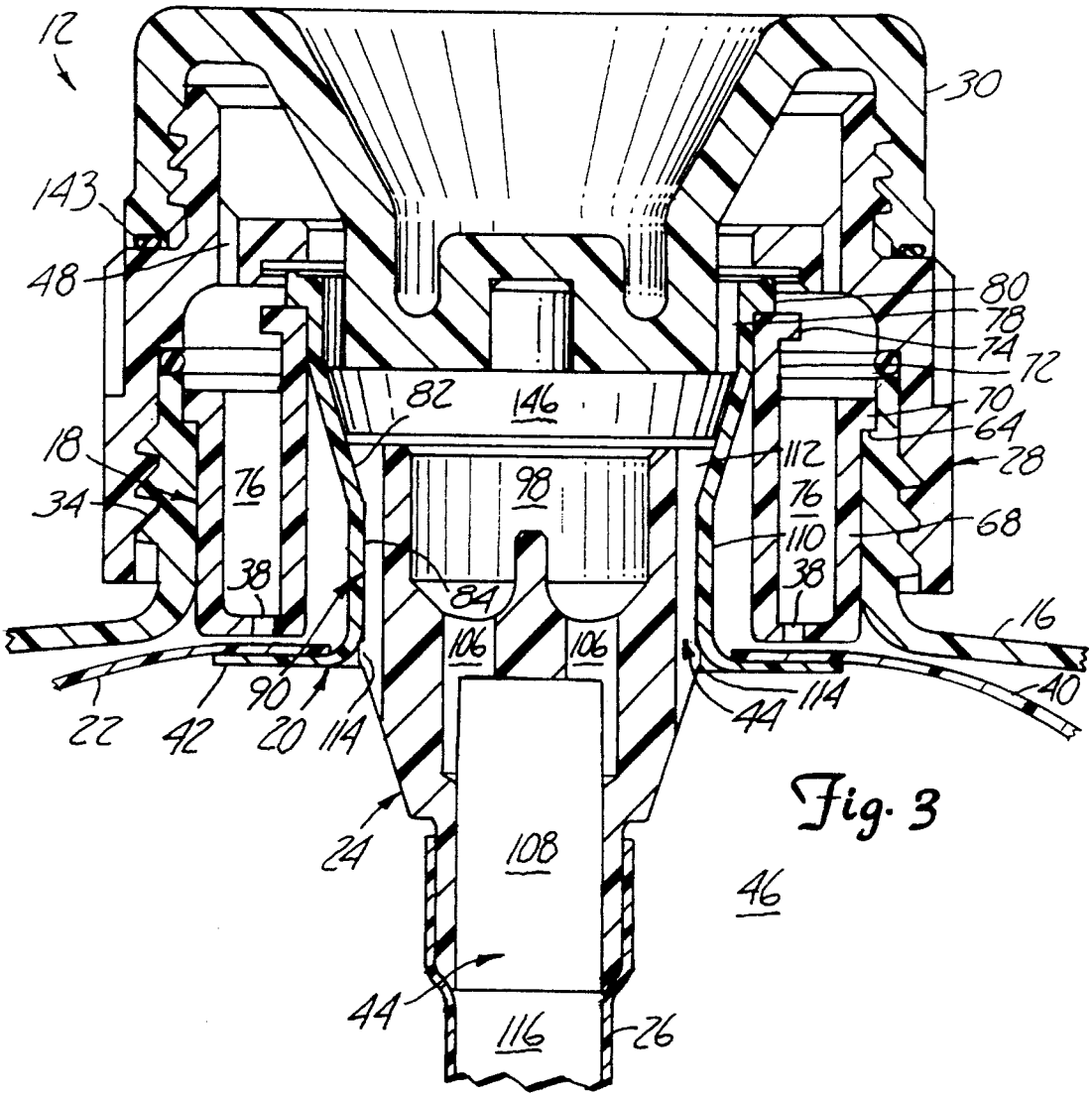
FIG. 3 is an assembled sectional view of a top portion of the container of FIG. 1

Container 12 is shown in more detail in FIGS. 2 and 3. FIG. 2 shows an exploded sectional view of a top end of container 12 and FIG. 3 shows an assembled sectional view of container 12. FIG. 2 is an exploded sectional view of a top end of container 12 with cap 30. FIG. 2 shows mouth 34 of outer container 16, retainer 18, fitment 20, clip tube coupling 24, dip tube 26, closure 28 and cap 30 in greater detail. As best shown by FIG. 2, mouth 34 of outer container 16 includes external threads 62, top edge 63 and an annular shoulder 64. Threads 62 extend around mouth 34 and are sized for engaging internal threads within closure 28. Shoulder 64 is formed within mouth 34 where the inner diameter of mouth 34 widens. Shoulder 64 provides a surface for mounting and supporting retainer 18, fitment 20 and dip tube coupling 24 within mouth 34.

Retainer 18, which mounts upon shoulder 64 within mouth 34, is preferably a clamshell-type ring joined by a living hinge. An example of such a clamshell-type ring is shown in U.S. Pat. No. 5,102,010 to Osgar et al., issued on Apr. 7, 1992, which is assigned to NOW Technologies, Inc. Retainer 18 mounts fitment 20 within mouth 34 of outer container 16 and includes floor portion 66, outer wall 68, outer lip 70, inner wall 72 and inner lip 74. Notches or grooves extend through floor 66 to define gas passages 38. Outer wall 68 integrally extends upward from floor portion 66 along an outer perimeter of retainer 18. Outer lip 70 integrally extends outward and horizontally from the top end of outet wall 68. Outer wall 68 abuts an inner surface of mouth 34 while outer lip 70 rests upon shoulder 64 of mouth 34 to support retainer 18 within mouth 34. Inner wall 72 integrally extends upward from floor member 66 along an inner perimeter of retainer 18. Inner wall 72, floor member 66 and outer wall 68 define a trough or channel 76 through which air or pressurized gas may be supplied to gas passage 38, which is in fluid communication with space 40 between flexible bag 22 and outer container 16 (as shown in FIG. 1). Inner lip 74 integrally extends horizontally outward from inner wall 72. Inner wall 72 abuts fitment 20 to stabilize fitment 20 while inner lip 74 supports fitment 20 within mouth 34. As can be appreciated, several alternative retainer structures may be employed for retaining and supporting fitment 20 within mouth 34. Alternatively, retainer 18 and fitment 20 may be formed as a single, integral component which mounts within mouth 34.

Fitment 20 is generally funnel-shaped and mounts within retainer 18 and mouth 34 of outer container 16. Fitment 20 includes mouth 78, lip 80, throat 82, neck 84, shoulder 42 and portal 86. Portal 86 extends through fitment 20 and is in communication with interior 46 of flexible bag 22 (see FIG. 3). Lip 80 is located at an upper end of mouth 78 and extends horizontally outward from mouth 78 at a 90° angle. Toward a lower end of mouth 78, fitment 20 narrows to form throat 82. Neck 84 extends from throat 82 down into outer container 16, at which point, fitment 20 extends outward substantially horizontal from neck 84 to form shoulder 42. Shoulder 42 supports flexible bag 22 within outer container 16. At the same time, mouth 78 abuts an inner perimeter of inner wall. 72 of retainer 18 and lip 80 rests upon inner lip 74 of retainer 18 so that fitment 20 is supported within mouth 34 by retainer 18.

Dip tube coupling 24 rests within fitment 20 and is preferably formed from polytetrafluoroethylene (PTFE). Coupling 24 includes main body 88, spacing element 90, fluid channels 92, shoulder 94, neck 96, cavity 98, sidewalls 100, arcuate floor 102, prong 104, upper bores 106 and central bore 108. Main body 88 is generally cylindrical in shape and has a maximum diameter less than the inner diameter of fitment 20. Spacing elements 90 protrude from main body 88 at spaced locations around a perimeter of main body 88. Spacing elements 90 space main body 88 from fitment 20 and stably secure dip tube coupling 24 within fitment 20 while defining fluid channels 92. Fluid channels 92 extend between spacing elements 90, main body 88 and fitment 20. Grooves or channels 92, together, provide fluid passage 44 which communicates with interior 46 of flexible bag 22 near a top end of container 12. In one preferred embodiment, dip tube coupling 24 includes four spacing elements 90 equidistantly spaced around dip tube coupling 24 so as to provide four equidistantly spaced grooves or channels 92. Each channel 92 has a depth of about 0.12 inches extending into main body 88 from an outer periphery or circumferential surface of spacing elements 90. Channels 92 are located at four locations equally spaced around main body 88. Each channel 92 has a width of about 0.86 inches which extends approximately 45° around main body 88. Alternatively, fluid passage 44 may be defined by any number of channels 92 having various orientations about fluid passage 43. In addition, channels 92 may have a variety of shapes or configurations including circular, oval or rectangular bores completely enclosed by dip tube coupling 24, or circular, oval or rectangular notches extending into the sides of dip tube coupling 24.

Each spacing element 90 includes central portion 110, chamfer 112 and protrusions 114. Central portion 110 is generally vertical. Chamfer 112 slants outwardly from central portion 110 toward an upper end of dip tube coupling 24. Chamfer 112 preferably slants out from central portion 110 at an angle so as to mate with throat 82 of fitment 20. Protrusions 114 have a diameter slightly greater than the inner diameter of fitment 20 and protrude or project outward from near a lower end of spacing elements 90. Protrusions 114 are preferably spaced from a lower end of chamfer 112 at a distance approximately equal to the length of neck 84 of fitment 20. During assembly, fitment 20 temporarily flexes as protrusions 114 are pressed through fitment 20. As a result, chamfer 112 rests upon throat 82 of fitment 20 while protrusions 114 extend below neck 84 of fitment 20 to secure dip tube coupling 24 within fitment 20 once container 12 is assembled. At the same time, however, protrusions 94 permit dip tube coupling 24 and dip tube 26 to be removed from fitment 20 for cleaning or disposal.

Toward a lower end of dip tube coupling 24, main body 88 narrows to form shoulder 94 and neck 96. Neck 96 is sized for mating with an upper end of dip tube 26 below shoulder 94.

Main body 88 further defines cavity 98, upper bores 106 and central bore 108. Cavity 98 extends downward into main body 88 and is defined by sidewalls 100 and arcuate floor 102. Cavity 98 is sized for reception of probe 50 of dispenser 14 (shown in FIG. 1). In the preferred embodiment, cavity 98 preferably has a depth of about 1.0 inches and a diameter of about 1.437 inches. Prong 104 is concentrically positioned within cavity 98 and projects upwardly from arcuate floor 102. Prong 104 is positioned so as to engage probe 50 of dispenser 14 to open flow passage 58 of probe 50. Prong 104 preferably terminates within cavity 98 at a distance of about 0.375 inches within cavity 98. As a result, prong 104 does not engage probe 50 until probe 50 is sufficiently inserted into cavity 98.

Upper bores 106 extend downwardly from cavity 98 and communicate with central bore 108. In one preferred embodiment, four upper bores 106 are equally spaced around prong 104 and have the diameter of about 0.312 inches.

Central bore 108 extends upwardly through neck 96 until in fluid communication with upper bores 106. Central bore 108 preferably has a diameter of about 0.87 inches. Together, cavity 98, upper bores 106 and central bore 108 form fluid passage 43. Dip tube coupling 26 includes a fluid conduit 116 which communicates with fluid passage 43 when container 12 is assembled.

Closure 28 encloses fitment 20, dip tube coupling 24 and mouth 34 of outer container 16. Closure 28 includes lower bore 120, shoulder 122, intermediate bores 124, flange 126, vent port 48, upper collar 128 and upper receiving bore 130. Lower bore 120 extends upward into closure 28 and has a diameter and internal threads 131 for engaging external threads 62 on mouth 34 of outer container 16. Near a top or lower bore 130, closure 28 narrows within bore 130 to form shoulder 122. Shoulder 122 is spaced from the bottom of closure 28 so as to compress an O-ring 132 against top edge 63 of mouth 34 to provide a seal between closure 28 and mouth 34. Above shoulder 122, closure 28 continues to narrow to form intermediate bores 124. Intermediate bores 124 extend above shoulder 122 and below flange 126. Intermediate bores 124 receive portions of retainer 18 and fitment 20 which extend above top edge 63 of mouth 34 when container 12 is assembled. Flange 126 projects inwardly above intermediate bores 124 and defines insertion port 134 for receiving and guiding probe 50 of dispenser 14. Flange 126 also defines vent ports 48 which extend through flange 126. In a preferred embodiment, closure 28 includes four vent ports 48; each vent port being equally spaced around closure 28 and having a length of about 0.93 inches and a width of about 0.06 inches. Vent ports 38 permit air or pressurized gas to flow into or to be supplied through vent ports 38, channel 76 and gas passages 38 into space 40 between flexible bag 22 and outer container 16.

Upper collar 128 extends above flange 126 and has external threads 136 for threadably engaging internal threads or dispenser 14. Upper collar 128 defines upper receiving bore 130 which receives probe 50 of dispenser 14. External threads 136 of upper collar 128 also threadably engage internal threads of cap 30 when cap 30 is mounted on closure 28.

Cap 30 includes rim 139, inner cavity 140, inner threads 142, O-ring 143, protrusion 144 and seal member 146. Rim 139 extends around an outer perimeter of cap 30 and defines inner cavity 140 while carrying O-ring 143. Inner cavity 140 is centered within a lower end of cap 30 and has internal threads 142 for engaging external threads 136 of closure 28. O-ring 143 is carried within a groove annularly extending around a lower end or rim 139. O-ring 143 compresses against closure 28 when cap 30 threadably engages closure 28 to create an annular seal between cap 30 and closure 28. Protrusion 144 extends from a top end of cap 30 into inner cavity 140. Protrusion 144 mates with and supports seal member 146 so that seal member 146 engages an upper end of fitment 20 to seal fitment 20 and container 12.

When container 12 is assembled, as best shown in FIG. 3, closure 28 threadably engages mouth 34 to enclose and protect retainer 18, fitment 20 and dip tube coupling 24, while also providing threads for mounting either cap 30 or dispenser 14. Dip tube coupling 24 is pressed into fitment 20 so that chamfers 112 of spacing elements 90 abut and rest upon throat 82 of fitment 20 and protrusion 114 is located below neck 84 of fitment 20 so that dip tube coupling 24 is temporarily locked in place within fitment 20. Lip 80 of fitment 20 rests upon inner lip 74 of retainer 18 while mouth 78 of retainer 18 abuts inner wall 62 of retainer 18 to mount and stably secure fitment 20 within retainer 18. At the same time, shoulder 42 of fitment 20 upholds flexible bag 22 within outer container 16. Outer lip 70 or retainer 18 rests upon shoulder 64 of mouth 34 while outer wall 68 abuts mouth 34 to support and stably secure retainer 18 within mouth 34. As a result, retainer 18, fitment 20 and dip tube coupling 24 are firmly upheld and mounted within mouth 34 of outer container 16 while flexible bag 22 is upheld within outer container 16. As can be appreciated, retainer 18, fitment 20 and clip tube coupling 24 may alternatively be formed as a single integrated component.

Upon being assembled, container 12 provides two distinct fluid passages in communication with interior 46 of flexible bag 22 and a separate gas passage in communication with space 40 between flexible bag 22 and outer container 16. Fluid passage 43 extends from cavity 98 through upper bores 106, central bore 108, fluid conduit 116 into interior 46 of flexible bag 22 near a bottom of flexible bag 22. Fluid passage 44 extends along dip tube coupling 24 around the circumferential surface of dip tube coupling 24 between spacing elements 90. Fluid passage 44 extends from an tipper end or fitment 20 between dip tube coupling 24 and fitment 20 to an upper end of interior 46 of flexible bag 22. Fluid passage 43 provides a conduit for dispensing or withdrawing fluids or liquid chemicals from flexible bag 22. Fluid passage 44 provides a conduit for recirculating or filling fluids back into interior 46 of flexible bag 22. In addition, fluid passage 44 also allows vapor pressure built up within flexible bag 22 during shipment to escape upon the removal of cap 30. By venting vapor pressure from flexible bag 22, fluid passage 44 prevent dangerous chemical spills caused by liquid chemical forced up through dip tube 26 by otherwise trapped vapor pressure within bag 22.

Both fluid passages are created through a single port defined by fitment 20. At the same time, because fluid passage 44 is formed circumferentially about fluid passage 43, fluid passage 44 has a large flow area through fitment 20 and can thus provide an adequate flow area for refilling liquid chemicals back into flexible bag 22. Moreover, fluid passage 43 and fluid passage 44 are defined by a single, easily manufactured component, dip tube coupling 24. To prevent back pressure within container 12 and to facilitate dispensing of liquid chemicals from container 12, container 12 also has a gas conduit extending through vent ports 38, trough 76 and gas passage 38. Because container 12 creates three distinct, concentric gas or fluid passages through a single mouth, liquids can be withdrawn and recirculated back into flexible bag 22 which also may be collapsed as air or pressurized gas flows into space 40.

Figure 4:
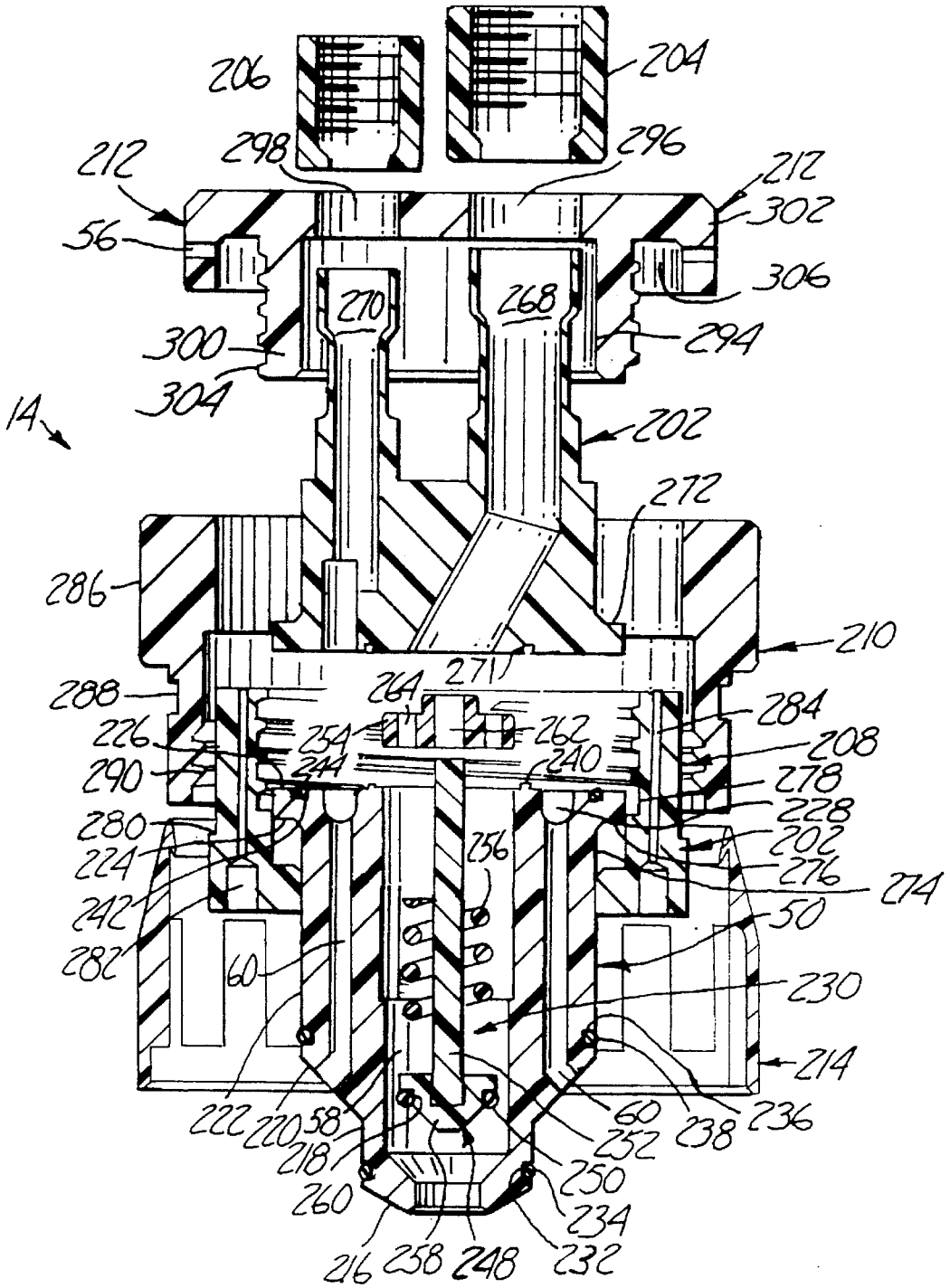
FIG. 4 is an exploded sectional view of the dispenser of FIG. 1.
Figure 5:
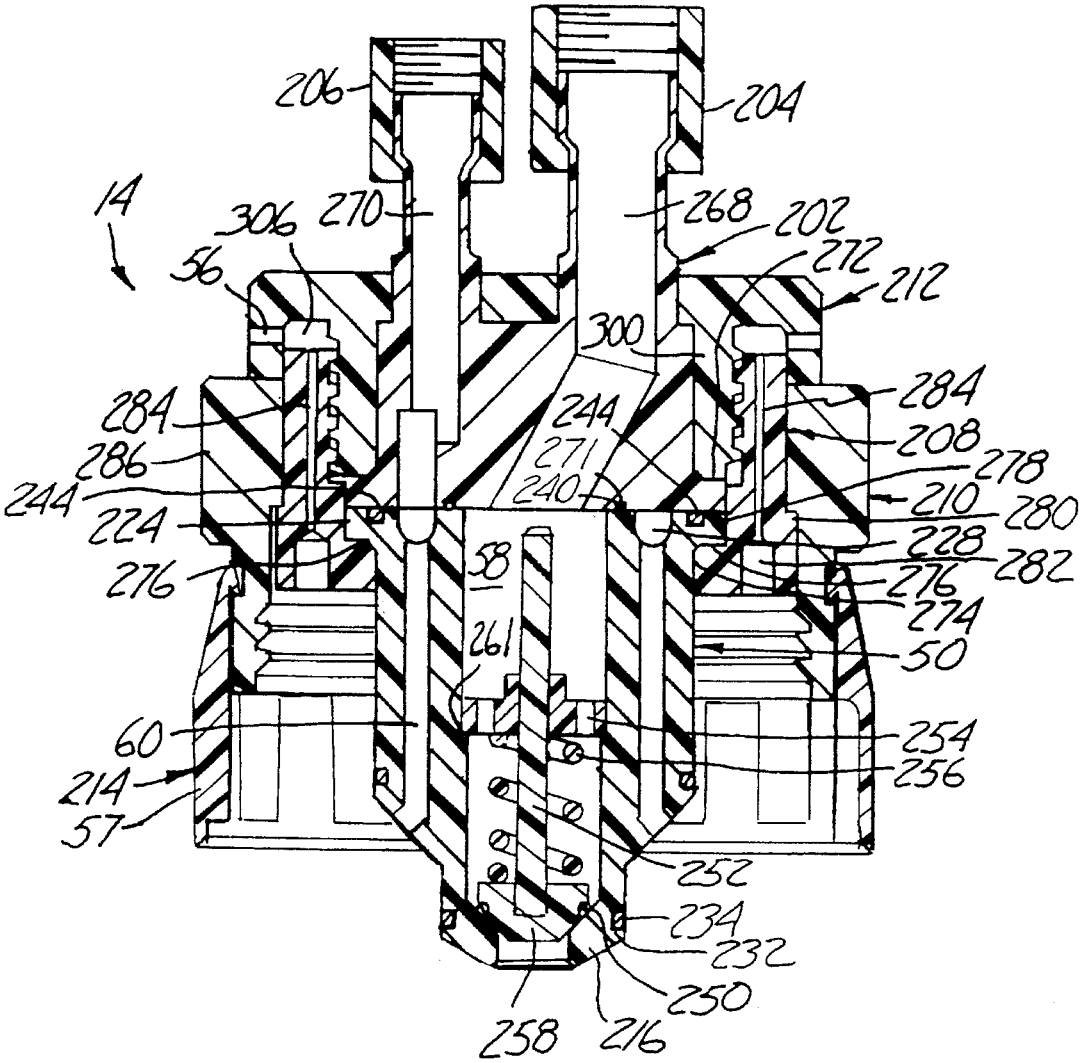
FIG. 5 is an assembled sectional view of the dispenser of FIG. 1.

Dispenser 14 is shown in more details in FIGS. 4 and 5. FIG. 4 shows an exploded sectional view of dispenser 14 and FIG. 5 shows an exploded sectional view of dispenser 14. As shown in FIG. 4, dispenser 14 includes probe 50, connector body 202, nuts 204,206, locking collar 208, lower connector 210, block nut 212 and key ring 2 14. Probe 50 (otherwise known as a check valve body) engages dip tube coupling 24 within fitment 20 to withdraw liquid chemicals from container 12 and to recirculate tested or filtered liquid chemicals back into container 12. Probe 50 includes tip 216, lower neck portion 218, shoulder 220, upper neck portion 222, upper shoulder 224, top surface 226, flow passage 58, flow passages 60, annular fluid channel 228 and poppet assembly 230. Tip 216 is located at a lower end of probe 50 below lower neck portion 218. Lower neck portion 218 includes an annular groove 232 for receiving O-ring 234. Lower neck portion 218 has a diameter sized so that lower neck portion 218 mates within cavity 98 of dip tube coupling 24. O-ring 234 extends around lower neck portion 218 and seals against sidewalls 100 of cavity 98 above flow passage 58 and below flow passages 60. At a distance above tip 216 which is slightly less than the depth of cavity 98, the diameter of lower neck portion 218 widens to form shoulder 220 and upper neck portion 222. Shoulder 220 slants upward from neck portion 218 to neck portion 222. A lower end of shoulder 220 has a diameter larger than the diameter of cavity 98 so as to prevent upper neck portion 222 from being inserted into cavity 98 of dip tube coupling 24.

Upper neck portion 222 includes groove 236 for receiving O-ring 238. O-ring 238 provides a seal between upper neck portion 222 and fitment 20 when probe 50 engages container 12. O-ring 238 provides a seal above flow passages 60. Upper neck portion 222 has a diameter sized so as to permit upper neck portion 222 to mate within fitment 20 of container 12. Near an upper end of upper neck portion 222, neck portion 222 widens to form shoulder 224. Shoulder 224 rests within locking collar 208 and supports probe 50 within dispenser 14.

Top mating surface 226 is located opposite tip 216 and includes seal or crush ring 240 and groove 242. Crush ring 240 projects upwardly from top surface 226 annularly between flow passage 58 and annular fluid channel 22. Crush ring 240 engages corresponding grooves within a lower surface of connector body 202. Crush ring 240 preferably has a height above top surface 226 greater than the depth of the corresponding grooves within the lower surface of connector body 202 so that crush ring 240 is crushed or smashed within the corresponding groove to create an annular seal around flow passage 58 between probe 50 and connector body 202. In the preferred embodiment, crush ring projects above top surface 226 at a height of about 0.060 inches while the corresponding groove in the lower surface of connector body 202 has a depth of about 0.055 inches. Crush ring 240 provides an annular seal without requiring the larger space typically necessary for conventional O-rings. Groove 242 receives O-ring 244 which annularly extends around annular fluid channel 228 to provide a seal around channel 228 between top surface 226 of probe 50 and connector body 202.

Annular fluid channel 228 extends into top surface 226 and annularly extends around flow passage 58. In the preferred embodiment, annular fluid passage 228 has a depth of about 0.3 inches. Annular fluid passage 228 is in fluid communication with flow passages 60 and allows fluid to flow from a single flow passage within connector body 202 to a plurality of flow passages within probe 50 extending around flow passage 58.

Flow passages 60 extend through probe 50 from annular fluid channel 228 and open at shoulder 220 between O-rings 238 and 234. In the preferred embodiment, probe 50 includes four flow passages 60 equally spaced around flow passage 58. Each flow passage 60 has a diameter of about 0.218 inches. Near shoulder 220, flow passages 60 angle outward at an angle of about 45°. As a result, flow passages 60 open into more direct, centered alignment with channels 92 of fluid passage 44 when probe 50 engages dip tube coupling 24. Flow passages 60 permit liquid chemicals to be refilled or recirculated through probe 50 into container 12 at the same time that liquid chemicals are being dispensed or drawn from container 12 through flow passage 58.

Flow passage 58 concentrically extends through probe 50 and opens at tip 216. Flow passage 58 preferably has a diameter of about 1.120 to about 1.125 inches. Flow passage 58 narrows as it opens through tip 216. Flow passage 58 preferably has a diameter of about 0.562 inches at its opening through tip 216. Flow passage 58 permits fluid to be dispensed or drawn out of container 12.

Poppet assembly 230 is positioned within flow passage 58 and permits flow passage 58 to be selectively opened and closed. Popper assembly 230 includes poppet 248, O-ring 250, poppet shaft 252, bushing 254 and spring 256. Popper 248 has a generally conical-shaped tip 258 and an outward projecting shoulder 260. Shoulder 260 carries O-ring 250 and presses O-ring 250 against tip 216 of probe 50 to provide a seal between poppet 258 and tip 216 so as to close off flow passage 58. Shoulder 260 and O-ring 250 further prevent popper 258 from projecting out of tip 216. As a result, shoulder 260 and O-ring 250 prevent poppet assembly 230 from being inadvertently actuated so as to accidentally open flow passage 58. Popper shaft 252 is coupled to a back side or poppet 258 and extends upwardly within flow passage 58 through bushing 254.

Bushing 254 is press fit against a shoulder 261 within flow passage 58 near a midpoint of probe 50. Bushing 254 includes a central concentric opening 262 and a plurality of concentric, circumferential openings 264 extending through bushing 254. Central opening 262 receives popper shaft 252 and guides popper shaft 252 axed popper 258 within flow passage 58. Openings 264 permit fluid to flow past bustling 254 into lower connector 202. In the preferred embodiment, bushing 254 includes four openings 264 equally spaced about central opening 262.

Spring 256 extends between the back surface of popper 258 and a front surface of bushing 254. Spring 256 biases poppet 258 and O-ring 250 against tip 216 to close flow passage 258. Upon the application of force to popper 258, poppet shaft 252 moves upward through bushing 254 as spring 256 is compressed to disengage poppet 258 and O-ring 250 from tip 216 and to open flow passage 58.

Connector body 202, nut 204 and nut 206 couple with probe 50 to fluidly connect flow passage 58 and flow passages 60 to additional conduits ultimately connected to dispensing equipment or filtering mechanisms. Connector body 202 includes dispensing conduit 268, recirculating conduit 270, groove 271 and shoulder 272. Dispensing conduit 268 extends through lower connector 202 and is in fluid communication with flow passage 58. Recirculating conduit 270 extends through lower connector 202 and is in fluid communication with annular fluid channel 228. Groove 2721 extends inwardly into a lower surface of connector body 202 around conduit 268. Groove 271 receives crush ring 240 of probe 50 to form a seal around flow passage 58 and conduit 268 between probe 50 and connector body 202. Shoulder 272 projects outwardly from lower connector 202 and provides a surface against which lock nut 212 presses against to secure connector body 202 against top surface 226 of probe 50.

Nuts 204 and 206 are sealed to fluid conduits 268 and 270, respectively. Nuts 204 and 206 each have inner threads for threadably engaging additional fluid connection means, such as tube dispense port 52 and tube recirculation port 54 shown in FIG. 1.

Lower connector 210, lock nut 212, locking collar 208 and key ring 214, together, mount, secure and align probe 50 and connector body 202 to closure 28 and container 12. Locking collar 208 is preferably formed from natural polypropylene and includes lower bore 274, shoulder 276, upper bore 278, shoulder 280, spanner bores 282 and vent passages 284. Lower bore 274 extends upward through locking collar 208 and has a diameter sized for reception of upper neck portion 222 of probe 50, but less than the diameter of shoulder 224 of probe 50. Lower bore 274 widens to form shoulder 276 and upper bore 278. Upper bore 278 has a diameter large enough for receiving shoulder 224 of probe 50 so that shoulder 224 rests upon shoulder 276 and is accurately aligned through lower bore 274. Upper bore 278 further includes internal threads for threadably engaging lock nut 212. The internal threads preferably comprise Dardelet self-locking right-hand threads. Shoulder 280 projects outwardly from the perimeter of locking collar 208. Shoulder 280 provides a surface for supporting lower connector 210. Spanner bores 282 extend upward through a lower surface of locking collar 208 and are used in conjunction with a spanner wrench to tighten locking collar 208. Spanner bores 208 are also in fluid communication with vent passages 284 which extend from spanner bores 208 through a top surface of locking collar 208.

Lower connector 210 is preferably formed from high density polyethylene and includes collar 286, groove 288 and internal threads 290. Collar 286 extends around an upper surface of lower connector 210 and projects inwardly so as to engage shoulder 280 of locking collar 208. Groove 288 extends along an outer circumference of lower connector 210 and receives an inward projecting hook of key ring 214. Inner threads 290 extend along an inner diameter of lower connector 210. Inner threads 290 threadably engage outer threads on closure 28 to couple dispenser 14 to closure 28 and container 12.

Lock nut 212 engages locking collar 208 to lock probe 50 and connector body 202 together and to lock lower connector 210 between locking collar 208 and lock nut 212. Lock nut 212 includes inner bore 294, dispensing conduit bore 296, recirculating conduit bore 298, externally threaded sleeve 300 and rim 302. Inner bore 294 concentrically extends upward into lock nut 212 and is sized for receiving fluid conduits 268 and 270 of connector body 202. Bores 296 and 298 extend upwardly through lock nut 212 from inner bore 294. Bores 296 and 298 have diameters large enough to receive fluid conduits 268 and 270, respectively. Externally threaded sleeve 300 projects downwardly around inner bore 294 and has external threads 304 for threadably engaging the internal threads of locking collar 208. Rim 302 is generally L-shaped and extends outward and downward from sleeve 300 to define cavity 306. Rim 302 further includes vent ports 56 which horizontally extend through rim 302 and are in fluid communication with cavity 306. Threads 304 of lock nut 212 threadably engage the internal threads of locking collar 208 to press a lower surface of sleeve 204 against shoulder 272 of connector body 202 and to press a lower surface of rim 302 against collar 286 of lower connector 210. As a result, lock nut 212 locks connector body 202 into coupling arrangement with probe 50 and fixedly couples lower connector 210 between locking collar 208 and lock nut 212. In addition, vent ports 56 permit air or pressurized gas to flow into or be supplied into space 40 through vent port 66, chamber 306, gas passages 284, spanner bore 282 and through mouth 34 of container 12.

Key ring 214 is preferably formed from high density polyethylene. Key ring 214 is annular in shape and includes mounting hooks 310, key code matching lugs 57 and central bore 312. Central bore 312 extends through key ring 214. Mounting hooks 310 project inwardly and downwardly into central bore 312 near a top .end of key ring 214. Mounting hooks 310 engage annular groove 288 of lower connector 210 and are thereby secured in place. Key code lugs 57 project inwardly along an inner circumferential surface of central bore 312. Key code lugs 57 are selectively spaced apart so as to match key code notches 47 positioned around closure 28. As a result, key code lugs 57 insure that dispenser 14 is not accidentally coupled to a wrong container.

When dispenser 14 is assembled, as best shown in FIG. 5, probe 50 and connector body 202 mate with one another so that fluid conduit 270 is in fluid communication with annular fluid channel 228 and flow passages 60 and so that fluid conduit 268 is in fluid communication with flow passage 58. Connector body 202 is aligned with probe 50 about mating lugs 240. Probe 50 is sealed against lower connector 202 by O-rings 244. As a result, two distinct liquid flow passages are provided through connector body 202 and probe 50. Poppet 258 of poppet assembly 230 is spring biased into a sealed relationship with tip 216 of probe 50. O-rings 250, carried by poppet 258, seals against tip 216 to close flow passage 58. However, application of force to poppet 258 moves poppet shaft 252 through bushing 254 to compress spring 258 and to thereby disengage O-ring 250 and poppet 258 from tip 216. As a result, fluid passage 58 is opened so that fluid may flow through fluid passage 58, through openings 264 within bushing 254, and up through fluid conduit 268.

Probe 50 and connector body 202 are held in coupled relationship to one another by locking collar 208 and lock nut 212. Shoulder 276 of locking collar 208 clamps against shoulder 224 of probe 50 while sleeve 300 clamps against shoulder 272 of connector body 202 to hold connector body 202 against probe 50. Lock nut 212 threadably engages locking collar 208 to hold connector body 202 against probe 50.

At the same time, lock nut 212 and locking collar 208 provide a gas conduit through dispenser 14 for allowing air or pressurized gas to flow into or be supplied into base 40 between flexible bag 22 and outer container 16 when dispenser 14 engages container 12. As shown in FIG. 5, vent ports 56 open into cavity 306 which is in fluid communication with gas passages 284 and spanner bores 282. Gas or pressurized air may flow through or be supplied through vent ports 56, cavity 306, gas passages 284 and spanner bores 282 into container 12.

Lower connector 2 10 mounts between locking collar 208 and lock nut 212. Collar 286 of lower connector 210 is clamped between rim 302 and lock nut 212 and shoulder 280 of locking collar 208. Threads 290 of lower connector 210 extend below locking collar 208 and surround probe 50 to provide means by which dispenser 14 may be connected to closure 28 of container 12.

Key ring 214 snaps or clamps around lower connector 210 by mounting hooks 310 which engage groove 288 of lower connector 210. Key code lugs 57 are suspended below threads 290 of lower connector 210. Key code lugs 57 provide a safety measure/or ensuring that dispenser 14 is connected to a container containing the proper chemicals or high purity fluids.

Figure 6:
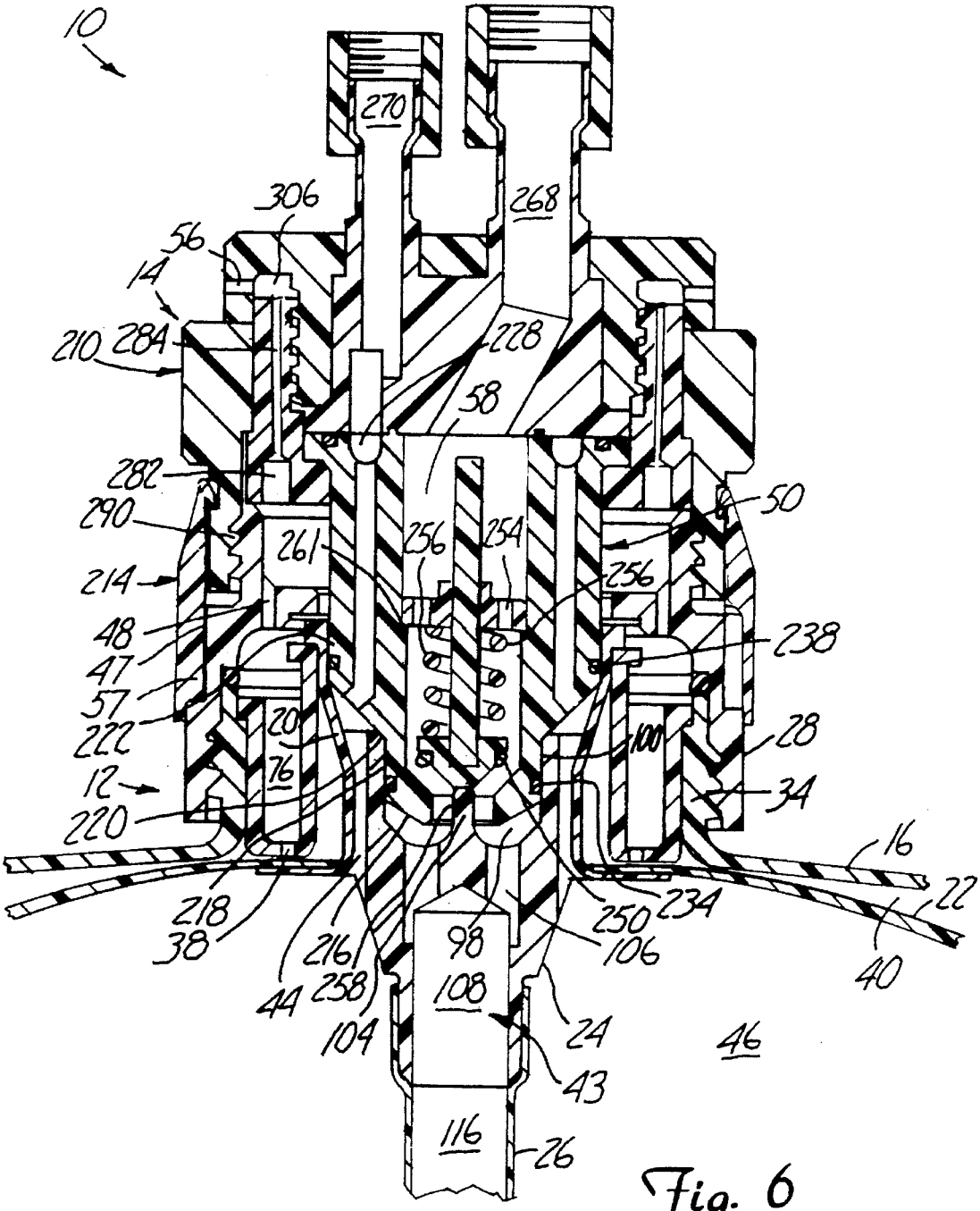
FIG. 6 is a sectional view of the dispenser of FIG. 1 engaging the container of FIG. 1.

FIG. 6 shows a sectional view of dispenser 14 engaging container 12 to withdraw liquid chemicals from interior 46 of flexible bag 42 and to recirculate liquid chemicals back into interior 46 of flexible bag 22. As shown in FIG. 6, dispenser 14 is lowered onto closure 28 or container 12. Key code 10 lugs 57 of key ring 214 initially engage key code notches 47 and closure 28 to match dispenser 14 with the correct container 12. If key code lugs do not match or correspond with key code notches 47 in closure 28 of container 12, dispenser 14 cannot engage closure 28 to withdraw fluids from container 12. If key code lugs 57 match key code notches 47, dispenser 14 is further lowered and mounted upon closure 28 with threads 290 of lower connector 2 to threadably engaging external threads of closure 28. Because key ring 214 is slidably clamped around lower connector 210, key ring 214 may be rotated about lower connector 210 as dispenser 14 is threadably mounted to closure 28 of container 12. As a result, dispenser 14 is removably coupled and aligned with closure 28 of container 12.

As dispenser 14 is threadably mounted upon closure 28, probe 50 engages fitment 20 and dip tube coupling 24. As shown by FIG. 6, tip 216 is positioned below prong 104, lower neck portion 218 is positioned within cavity 98, and upper neck portion 222 is partially positioned within fitment 20. Because lower neck portion 218 has a diameter slightly less than the diameter of cavity 98, lower neck portion 218 mates within cavity 98 against side walls 100. O-ring 234 provides a seal between side walls 100 of cavity 98 and lower neck portion 218 of probe 50. Similarly, upper neck portion 222 mates within fitment 20 so that O-ring 238 provides a seal between upper neck portion 222 and fitment 20. Because O-rings 234 and 238 horizontally press against the sides of cavity 98 and fitment 20, side loads or forces applied to either dispenser 14 or container 12 do not break the seal established by O-rings 234 and 238. Shoulder 220 engages a top end of dip tube coupling 24 to limit downward movement of probe 50 into fitment 20 and dip tube coupling 24. Shoulder 220 is angled so as to permit lower neck portion 218 to move downward into cavity 98 until prong 104 extends through tip 216 and engages poppet 258. As a result, popper 258 and popper: shaft 252 are moved upwardly within flow passage 58 to compress spring 256 and to open flow passage 58. When dispenser 14 is disengaged from container 12, spring 256 once again biases poppet 258 and O-ring 234 into engagement with tip 216 so as to close flow passage 58. As a result, fluid cannot be accidentally dispensed from container 12 until dispenser 14 is adequately connected to container 12. Moreover, because poppet 258 does not extend beyond tip 216, poppet 258 cannot be accidentally actuated to open flow passage 58.

When dispenser 14 is mounted upon container 12, system 10 provides two distinct liquid conduits or flow passages through mouth 34 of container 12 into interior 46 of flexible bag 22 and an additional gas conduit through mouth 34 into space 40 between outer container 16 and flexible bag 22. A dispensing fluid passage is provided through fluid conduit 116 of clip tube 26; bores 108. 106 and cavity 98 of dip tube coupling 24; and flow passage 58 and fluid conduit 268 of dispenser 14. A recirculation fluid passage is provided through fluid conduit 270, annular fluid channel 228 and flow passages 60 of dispenser 14 and fluid passages 44 of dip tube coupling 24. Gas conduits are provided through vent ports 56, cavity 306, gas passages 284 and spanner bores 282 of dispenser 14; and vent ports 48, trough 76 and gas passages 38 to container 12. Because system 10 provides both a liquid dispensing conduit and a liquid recirculation conduit through mouth 34 of container 16, specialized containers having two openings are not required for such procedures as testing and filtering of chemicals from a single container. Because system 10 also provides an additional gas passage through mouth 34, container 12 may employ an inner flexible bag 22 which is more aseptic, easier to clean, and easier to handle. Because fluid passage 44 circumferentially extends along and around fluid passage 43, greater liquid flow area is created through fitment 20 and dip tube coupling 24. Fluid passages 43 and 44 have flow areas large enough to permit quick and efficient dispensing of liquid chemicals from inner bag 22 and recirculation of liquid chemicals back into bag 22. At the same time, pressurized gas may be supplied through the gas conduit to further increase the dispensing of liquid chemicals from flexible bag 22. As can be appreciated, system 10 may be used solely for the purpose of dispensing liquid chemicals from flexible bag 22. However, system 10 also provides the option of recirculating tile dispensed liquid chemicals or adding additional liquid chemicals back into flexible bag 22.

Although the present invention has been described with reference to preferred embodiments, workers skilled in the art will recognize that changes may be made in form and detail without departing from the spirit and scope of the invention.

What is claimed is:

1. A container system for use with a fluid probe, the container system comprising:

an outer container having a mouth;

a flexible bag having an interior and a port; means for supporting the flexible bag within the outer container a coupling member for insertion into the mouth, the coupling member defining a first fluid passage and a second fluid passage, wherein the first fluid passage terminates within the flexible bag at a first location, wherein the second fluid passage terminates within the flexible bag at a second location and provides fluid communication with the interior of the flexible bag when the coupling member is fully engaged by the probe, and wherein the second fluid passage comprises at least one fluid channel circumferentially extending along the first fluid passage; and vent means for permitting gas flow between the outer container and the flexible bag to allow the flexible bag to collapse as fluid is dispensed from the flexible bag.

2. The container system of claim 1 wherein the coupling member comprises a dip tube coupling and wherein the container system further includes:

a dip tube having a fluid conduit from an upper end to a lower end of the dip tube, wherein the dip tube is coupled to the dip tube coupling so that the fluid conduit at least partially defines the first fluid passage.

3. The container system of claim 2 wherein the container system further includes:

means for receiving fluid under pressure between the outer container and the flexible bag to force fluid out of the flexible bag through the fluid conduit of the dip tube and through the first fluid passage.

4. The container of claim 1 wherein the means for supporting includes:

a fitment for mounting in the mouth, wherein the fitment defines the port, and wherein the flexible bag is mounted to a lower end of the fitment and is positioned within the outer container; and a retainer for mounting the fitment within the mouth of the outer container.

5. The system of claim 1 wherein the first fluid passage comprises a channel concentrically extending through the coupling member and wherein the second fluid passage includes a plurality of notches circumferentially extending around the periphery of the coupling member,

6. A container system for use with a fluid probe, the container system comprising:

an outer container having a mouth;

a flexible bag having an interior and a port;

a fitment for mounting in the mouth, wherein the flexible bag is mounted to a lower end of the fitment so that the fitment defines the port and so that the flexible bag is positioned within the other container;

a retainer for mounting the fitment within the mouth of the container; and a coupling member for insertion into the port, the coupling member defining a first fluid passage and a second fluid passage, wherein the first fluid passage terminates within the interior of the flexible bag at a first location and wherein the second fluid passage terminates within the flexible bag at a second location and provides fluid communication with the interior of the flexible bag when the coupling member is fully engaged by the probe, wherein the first fluid passage concentrically extends through the coupling member and wherein the second fluid passage circumferentially extends along the first fluid passage.

7. The container system of claim 6 wherein tile second fluid passage comprises:

a plurality of notches extending along an outer side of the coupling member and circumferentially positioned around the first fluid passage.

* * * * *

UNITED STATES PATENT AND TRADEMARK OFFICE

CERTIFICATE OF CORRECTION

PATENT NO. : 5,526,956

DATED : JUNE 18, 1996

INVENTOR(S) : MICHAEL L. OSGAR

It is certified that error appears in the above-indentified patent and that said Letters Patent is hereby corrected as shown below:

Col. 3, line 1, after "of", delete ":"

Col. 3, line 46, delete "or", insert --of--

Col. 4, line 18, delete "robe", insert --tube--

Col. 4, line 21, after "18", delete "."

Col. 5, line 5, delete "tip", insert --up--

Col. 5, line 7, delete "tip", insert --up--

Col. 5, line 45, delete "tile", insert --the--

Col. 5, line 56, delete "clip", insert --dip--

Col. 6, line 11, delete "outlet", insert --outer--

Col. 6, line 41, after "wall", delete "."

Col. 6, line 45, delete "polytetrafluoroethylene", insert --polytetraflouroethylene--

UNITED STATES PATENT AND TRADEMARK OFFICE

CERTIFICATE OF CORRECTION

PATENT NO. : 5,526,956

DATED : JUNE 18, 1996

INVENTOR(S) : MICHAEL L. OSGAR

It is certified that error appears in the above-indentified patent and that said Letters Patent is hereby corrected as shown below:

Col. 7, line 64, delete "or", insert --of--

Col. 8, line 21, delete "or", insert --of--

Col. 8, line 33, delete "or", insert --of--

Col. 8, line 53, delete "or", insert --of--

Col. 8, line 60, delete "clip", insert --dip--

Col. 9, line 5, delete "tipper", insert --upper--, delete "or", insert --of--

Col. 9, line 38, delete "2 14", insert --214--

Col. 10, line 55, delete "popper", insert --poppet--

Col. 10, line 56, delete "popper", insert --poppet--

Col. 10, line 62, delete "popper", insert --poppet--

Col. 10, line 65, delete "popper", insert --poppet--

UNITED STATES PATENT AND TRADEMARK OFFICE

CERTIFICATE OF CORRECTION

PATENT NO. : 5,526,956
DATED : JUNE 18, 1996
INVENTOR(S) : MICHAEL L. OSGAR

It is certified that error appears in the above-indentified patent and that said Letters Patent is hereby corrected as shown below:

Col. 11, line 5, delete "popper", insert --poppet--

Col. 11, line 6, delete both occurrences of "popper", insert --poppet--, delete "axed", insert --and--

Col. 11, line 7, delete "bustling", insert --bushing--

Col. 11, line 14, delete "popper", insert --poppet--

Col. 11, line 28, delete "2721", insert --271--

Col. 12, line 44, after "top", delete "."

Col. 13, line 23, delete "2 10", insert --210--

Col. 13, line 34, delete "measure/or", insert --measure for--

Col. 13, line 41, delete "or", insert --of--

Col. 13, line 42, before "lugs", delete "10"

Col. 13, line 50, after "connector", delete "2 to", insert --210--

Col. 14, line 12, delete both occurrences of "popper", insert --poppet--,before "shaft", delete ":"

Col. 14, line 28, delete "clip", insert --dip--, after "108", delete ".", insert --,--

Col. 14, line 56, delete "tile", insert --the--

UNITED STATES PATENT AND TRADEMARK OFFICE

CERTIFICATE OF CORRECTION

PATENT NO. : 5,526,956

DATED : June 18, 1996

INVENTOR(S) : Michael L. Osgar

It is certified that error appears in the above-indentified patent and that said Letters Patent is hereby corrected as shown below:

Col. 16, line 28, delete "tile", insert --the--

Signed and Sealed this

Twentieth Day of May, 1997

*Attest:*

Bruce Lehman

BRUCE LEHMAN

*Attesting Officer*

*Commissioner of Patents and Trademarks*